US005974823A

United States Patent [19]

Banno et al.

[11] Patent Number: 5,974,823

[45] Date of Patent: Nov. 2, 1999

[54] AUGER TYPE ICE MAKING MACHINE

[75] Inventors: Shinya Banno, Aichi-ken; Jiro Yamamoto, Yokkaichi, both of Japan

[73] Assignee: Hoshizaki Denki Kabushiki Kaisha, Toyoake, Japan

[21] Appl. No.: 09/089,050

[22] Filed: Jun. 2, 1998

[30] Foreign Application Priority Data

Jun. 2, 1997 [JP] Japan ..... 9-144300

[51] Int. Cl.[6] ..... F25C 1/14

[52] U.S. Cl. ..... 62/354

[58] Field of Search ..... 62/354; 403/273, 403/334, 359.6, 361; 384/246; 464/147, 154, 158

[56] References Cited

U.S. PATENT DOCUMENTS

| | | | |
|---|---|---|---|
| 2,111,629 | 3/1938 | Holtz | 384/246 |
| 3,197,974 | 8/1965 | Smith et al. | 62/354 |
| 3,863,463 | 2/1975 | Utter et al. | 62/354 |
| 4,134,700 | 1/1979 | Nelson et al. | 403/334 |
| 4,250,718 | 2/1981 | Brantley | 62/354 |
| 5,189,891 | 3/1993 | Sakamoto | 62/354 |
| 5,605,050 | 2/1997 | Tatematsu et al. | 62/354 |

*Primary Examiner*—William E. Tapolcai
*Attorney, Agent, or Firm*—Nikaido, Marmelstein, Murray & Oram LLP

[57] ABSTRACT

An auger type ice making machine having an auger composed of an auger body integrally formed thereon with a helical blade and a support shaft united with a lower end of the auger body, the auger being mounted for rotary movement with an evaporator housing and connected at its support shaft to an output shaft of a drive mechanism for rotation therewith, wherein the support shaft of said auger is composed of a cylindrical joint member formed in a predetermined axial length and having a joint portion formed to be coupled with the output shaft for rotation therewith and a columnar support member coupled with an internal bore of the joint member, and wherein the columnar support member is formed with a conical recess tapered upward from its lower end and positioned concentrically with the internal bore of the joint member.

8 Claims, 6 Drawing Sheets

AUGER TYPE ICE MAKING MACHINE

BACKGROUND OF THE INVENTION

1. Field of the Invention

The present invention relates to an auger type ice making machine and more particularly to an improvement of an auger adapted for use in the ice making machine.

2. Description of the Prior Art

Provided in a conventional auger type ice masking machine is an auger of the type composed of an auger body integrally formed thereon with a helical blade and a support shaft united with a lower end of the auger body. The auger is mounted for rotary movement within an evaporator housing of the ice making machine and connected at its support shaft to an output shaft of a drive mechanism for rotation therewith. When rotated by operation of the drive mechanism, the auger scrapes ice crystals frozen on the internal surface of the evaporator housing and advances the scraped ice crystals upward for discharge.

In general, the support shaft of the auger is coaxially united with the lower end of the auger body by friction welding. The support shaft of the auger is formed by machining a solid columnar metallic material and is connected to the output shaft of the drive mechanism by means of a spline joint coupled with external splines respectively formed on the output shaft and support shaft. Alternatively, an internal spline formed in the support shaft is coupled with an external spline formed on the output shaft.

Since the support shaft of the auger is formed separately from the auger body and united with the lower end of the auger body coaxially therewith by friction welding, it is required to preliminarily form an extra portion on the upper end of the support shaft to be removed as burrs during the process of friction welding. The extra portion on the upper end of the support shaft becomes useless after united with the auger body. This results in an increase of the manufacturing cost of the auger.

In the case that the internal spline of the support shaft is coupled with the external spline of the output shaft without using the spline joint for connection to the output shaft, it is required to form the internal spline on the internal periphery of the support shaft. To form the internal spline in the support shaft, special machining such as electric discharge machining is required. This also results in an increase of the manufacturing cost of the auger.

SUMMARY OF THE INVENTION

It is, therefore, an object of the present invention to provide an auger type ice making machine the auger of which can be manufactured at a low cost.

According to the present invention, there is provided an auger type ice making machine having an auger composed of an auger body integrally formed thereon with a helical blade and a support shaft united with a lower end of the auger body, the auger being mounted for rotary movement within an evaporator housing and connected at its support shaft to an output shaft or a drive mechanism for rotation therewith, wherein the support shaft of said auger is composed of a cylindrical joint member formed in a predetermined axial length and having a joint portion formed to be coupled with the output shaft for rotation therewith and a columnar support member coupled within an internal bore of the joint member, and wherein the columnar support member is formed therein with a conical recess tapered upward from its lower end for engagement with an upper end of the output shaft and positioned concentrically with the internal bore of the joint member.

In the ice making machine according to the present invention, it is preferable that the cylindrical joint member is splined in its joint portion. It is also preferable that the columnar support member is spaced in a predetermined distance lower than the upper end of the joint member when the support shaft is united with the auger body.

In the ice making machine according to the present invention, it is preferable that the joint member and the columnar support member of the auger are made of different metallic materials. Preferably, the columnar support member is made of a metallic material smaller in coefficient of linear expansion or specific heat than that of the joint member or lower in thermal conductivity than that of the joint member.

In the auger of the ice making machine according to the present invention, it is preferable that the columnar support member is formed at its outer periphery with a helical communication groove for communicating an end face of the joint member united with the lower end face or the auger body to the exterior or formed at its central portion with an axial bore in open communication with the conical recess.

Since in the ice making machine, the support shaft of the auger is composed of the separately formed joint member and columnar support member, the joint portion of the joint member and the conical recess of the support member can be separately formed in a simple manner without special machining such as electric discharge machining. Thus, the machining time of the support shaft can be shortened to decrease the manufacturing cost of the auger.

As in the support shaft of the auger, the joint member is in the form of a cylindrical member while only the support member is in the form of a solid member, the joint member can be welded to the auger body at a small engagement area to decrease a portion eliminated during the process of friction welding. This is useful to reduce the material cost of the support shaft and to shorten the process time of friction welding.

In the auger type ice making machine according to the present invention, the joint member and columnar support member can be made of different metallic materials. Thus, the support member can be made of inexpensive metallic material to reduce the manufacturing cost of the auger. In the case that the columnar support member is made of a metallic material smaller in coefficient of linear expansion than that of the joint member, the thermal stress caused by rise of temperature during the process of friction welding is decreased to decrease strain of the support shaft. In the case that the columnar support member is made of a metallic material smaller in specific heat than that of the joint member or lower in thermal conductivity than that of the joint member, the heating time during the process of friction welding can be shortened to reduce the process time of friction welding and to enhance the manufacturing efficiency of the auger.

In the auger type ice making machine, the support shaft of the auger may be provided with a communication groove for communicating an end face of the joint member engaged with the lower end face of the auger body to the exterior. The communication groove is useful to discharge the air under high pressure caused by the friction welding to the exterior from the interior of the joint member and to discharge therethrough a melted portion of the joint member during the process of friction welding. This is effective to firmly connect the support shaft to the auger body. In a practical embodiment, the communication groove may be formed on the outer periphery of the support member in an appropriate shaft or replaced with an axial hole formed in open communication with the conical recess of the support member to discharge the air under high pressure to the exterior.

BRIEF DESCRIPTION OF THE DRAWINGS

Other objects, features and advantages of the present invention will be more readily appreciated from the following detailed description of preferred embodiments thereof when taken together with the accompanying drawings, in which.

DESCRIPTION OF THE PREFERRED EMBODIMENTS

Figure 1:
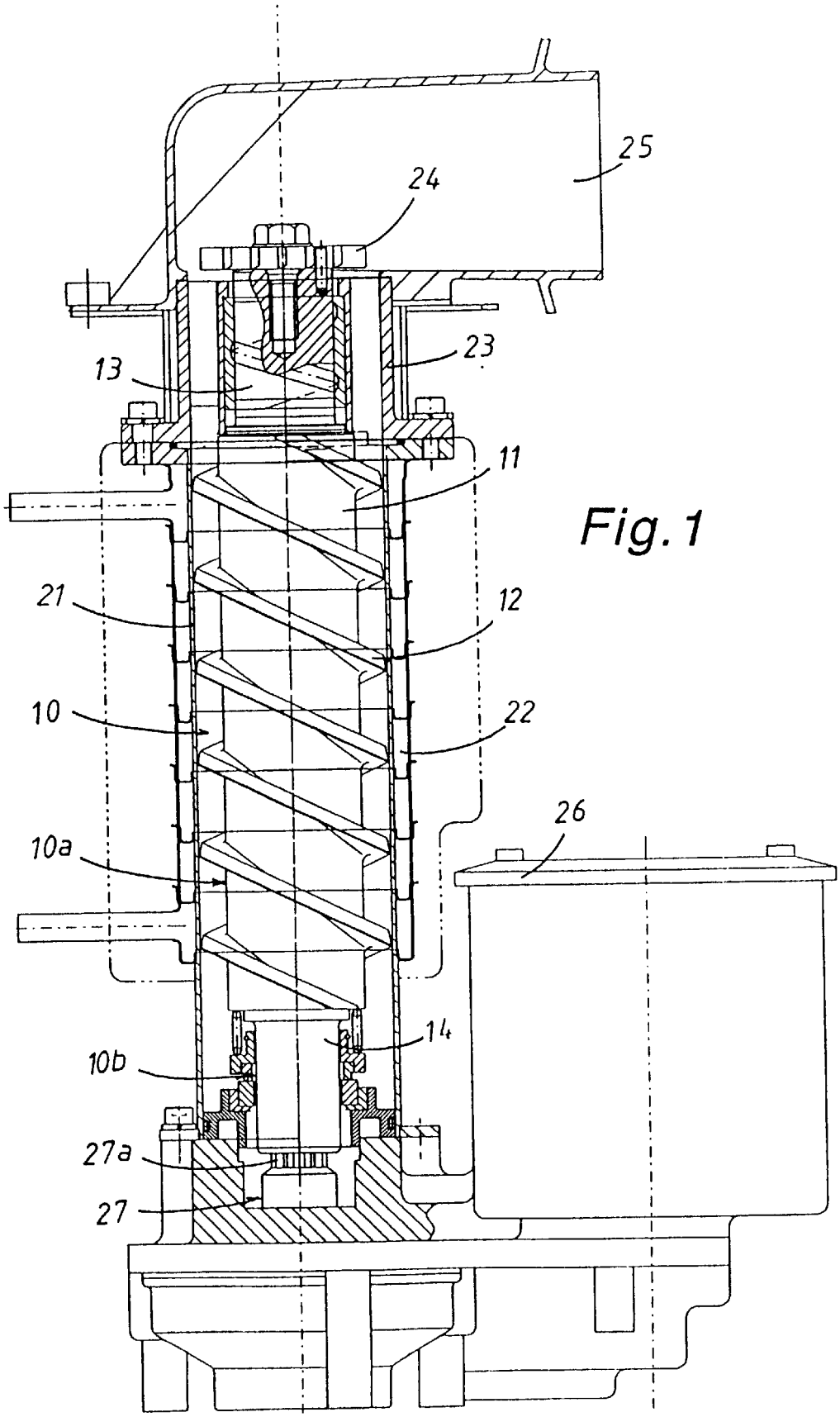
FIG. 1 is a vertical sectional view of an auger type ice making machine in accordance with the present invention.

Hereinafter, the present invention will be described with reference to the drawings. Illustrated in FIG. 1 is an auger type ice making machine in accordance with the present invention which is composed of an ice making mechanism and a drive mechanism. The ice making mechanism includes an auger 10, an evaporator housing 21 formed to contain the auger 10, a freezing coil 22 helically wound around the evaporator housing 21, an extrusion head 23 and a cutter 24 fixedly mounted on the upper end of auger 10, and an ice discharge duct 25.

The auger 10 is connected at its lower end with an output shaft 27 of the drive mechanism for rotation therewith in a condition where it has been coupled within the evaporator housing 21. The auger 10 is rotatably supported by the extrusion lead 23 at its upper end through a bearing, and the cutter 24 is mounted on the upper end of auger 10. Compression passages of extrusion head 23 are communicated at their lower ends with the interior of evaporator housing 21 and at their upper ends with the ice discharge duct 25, and the blade of cutter 24 is located at the upper end openings of the compression passages.

The drive mechanism includes an electric motor 26 which is drivingly connected to the output shaft 27 by means of a speed reduction gear train. The output shaft 27 is coaxially projected upward in a predetermined length at the bottom of evaporator housing 21 and is connected to the lower end of auger 10 for rotation therewith. In the ice making machine, fresh water for ice is supplied into the evaporator housing 21 from a water supply conduit (not shown) and chilled by refrigerant flowing through the freezing coil 22 to form ice crystals on the internal surface of evaporator housing 21. The ice crystals are scraped by the helical blade 12 of auger 10, and the scraped ice crystals are advanced upward toward the upper end of evaporator housing 21 and compressed in the course of passing through the compression passages of extrusion head 23. The compressed ice crystals are continuously extruded as rods of dehydrated ice from the compression passages of extrusion head 23 and broken by the cutter 24 into ice pieces. Thus, the ice pieces are discharged from the discharge duct 25.

Figure 2:
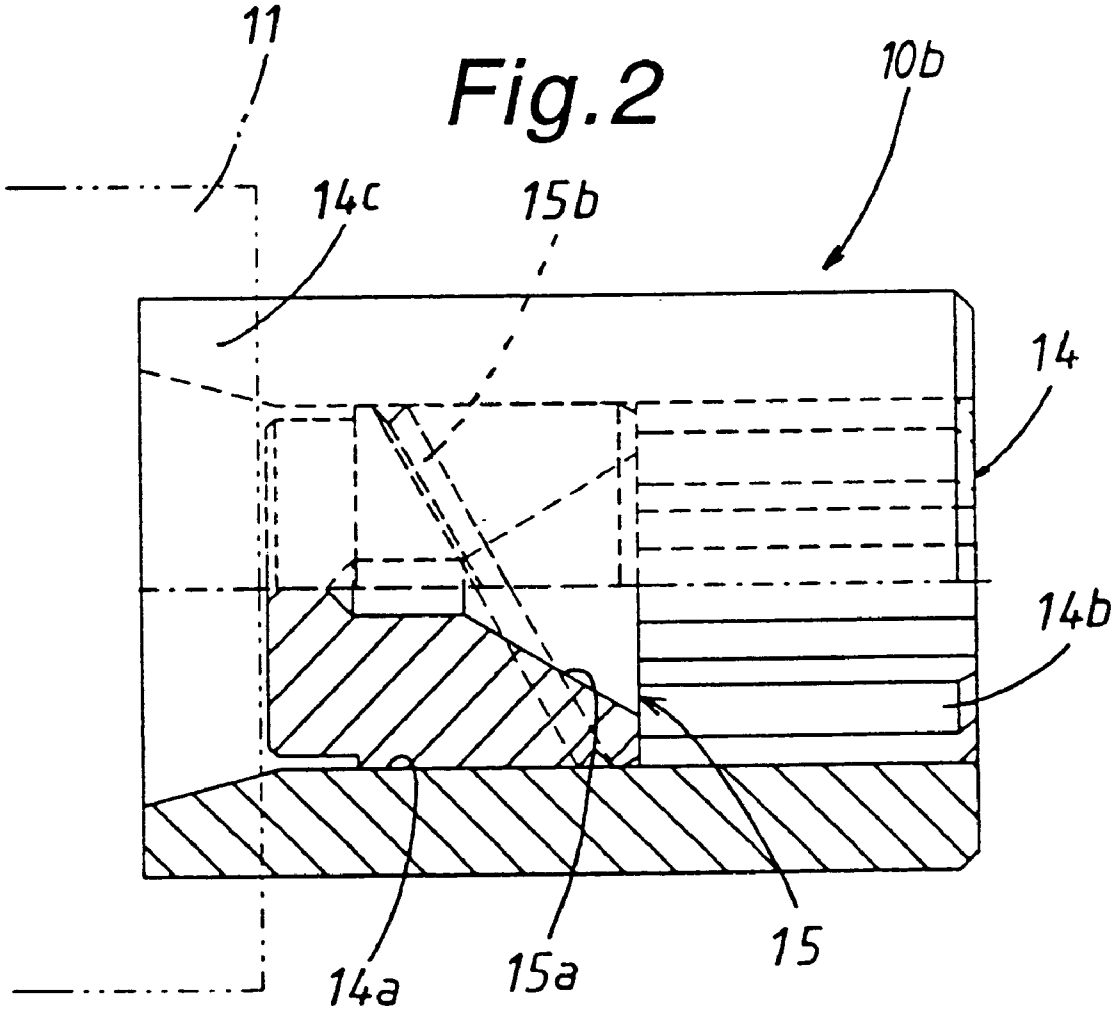
FIG. 2 is a partly sectional view of a support shaft of an auger shown in FIG. 1.
Figure 3:
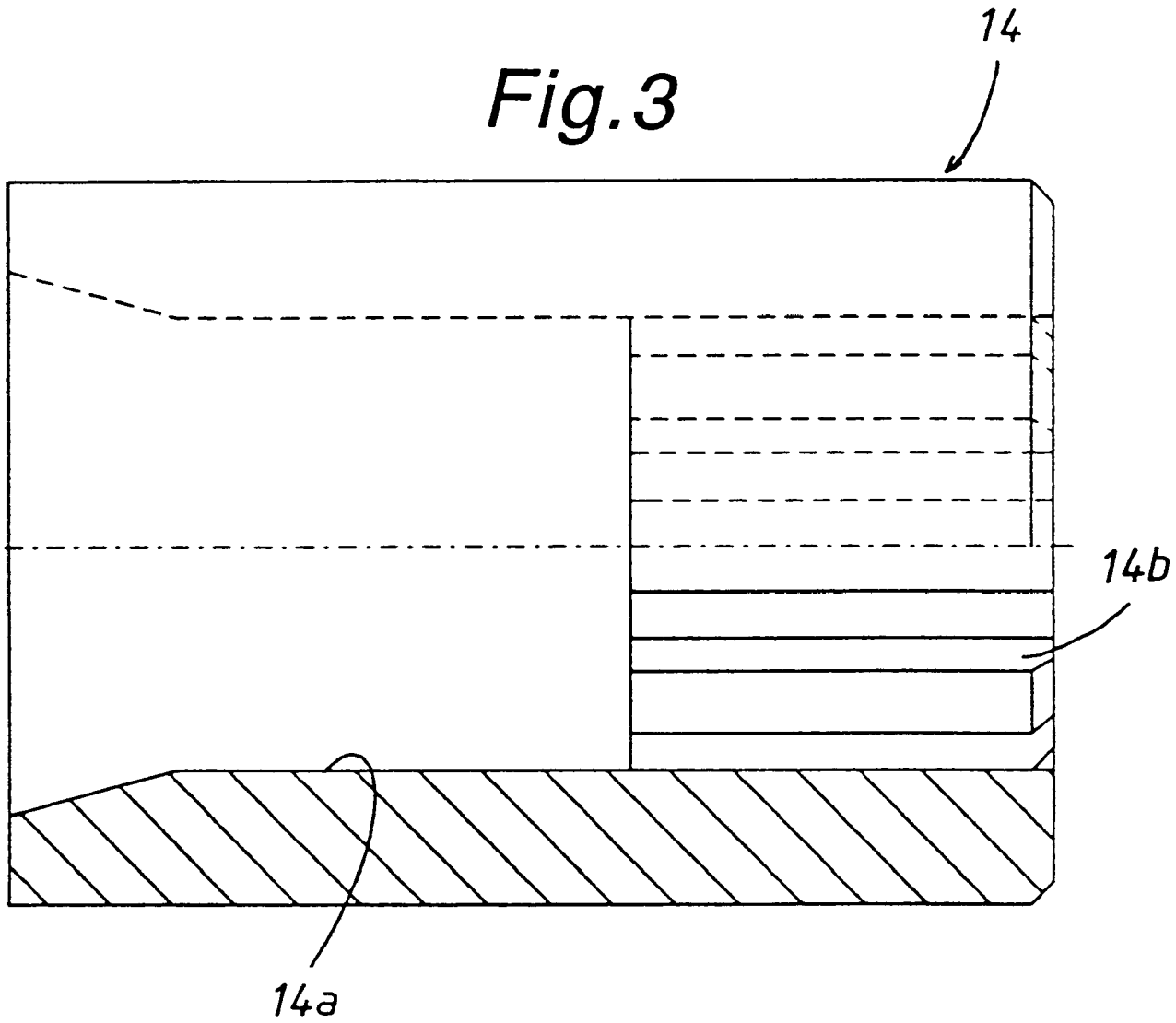
FIG. 3 is a partly sectional view of a joint member of the support shaft.
Figure 4:
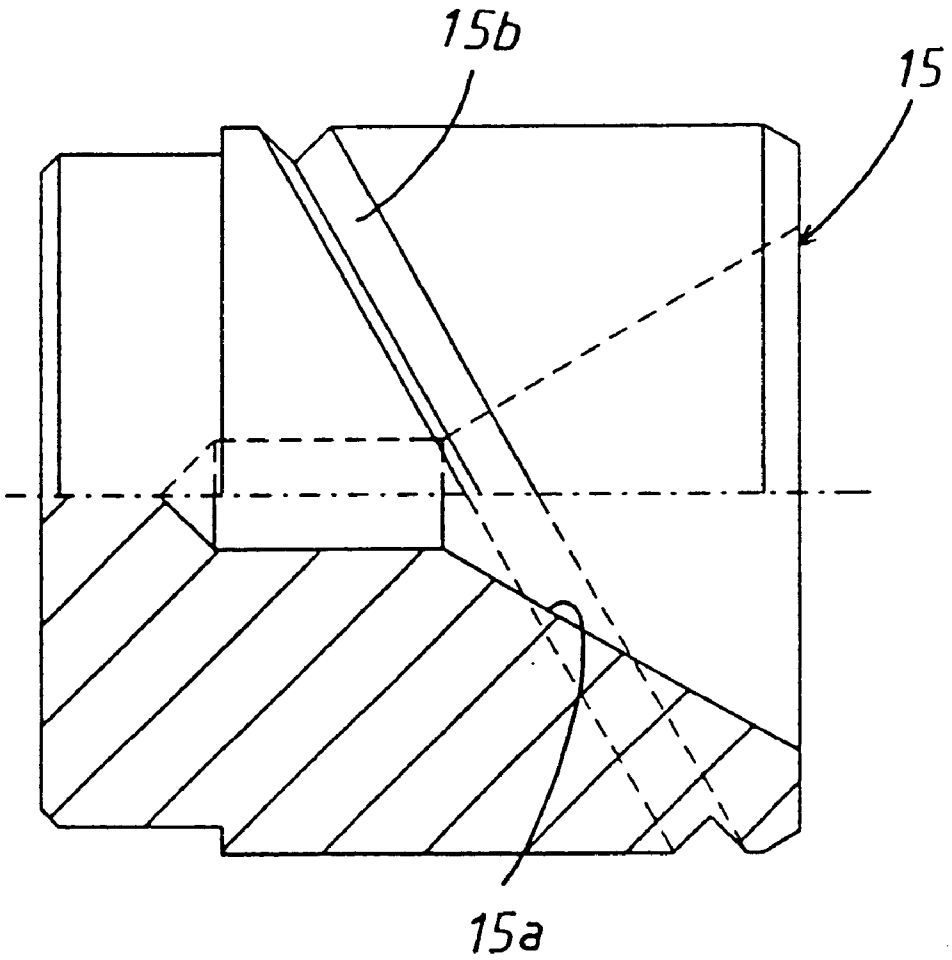
FIG. 4 is a partly sectional view of a support member of the support shaft.

The auger 10 is composed of an auger body 10*a* and a support shaft 10*b*. The auger body 10 has a cylindrical portion 11 integrally formed thereon with a helical blade 12 and at its upper end with a support shaft 13. The support shaft 10*b* is coaxially united with the lower end of auger body 10*a* by friction welding. As shown in FIGS. 2 to 4, the support shaft 10*b* is composed of a joint member 14 and a support member 15. The joint member 14 is in the form of a cylindrical body made of stainless steel (SUS 304) as well as the auger body 10*a*, while the support member 15 is in the form of a stepped columnar body made of iron and coupled within an internal bore 14*a* or the cylindrical joint member 14 with press-fit. That is to say, the joint member 14 and support member 15 are made of different metallic materials.

The joint member 14 is formed at its lower end portion with an internal spline 14*b* to be coupled with an external spline 27*a* formed on the output shaft 27 of the drive mechanism. On the other hand, tire cylindrical support member 15 is formed therein with a conical recess 15*a* opening toward its lower end and formed at its outer periphery with a helical groove 15*b* of V-shape in cross-section. The helical groove 15*b* is extended from the lower end of support member 15 to the stepped portion of support member 15. The support member 15 is coupled within the joint member 14 with press-fit and positioned at the upper end of internal spline 14*b* such that the head 27*b* of output shaft 27 is retained by engagement with the conical recess 15*a* of support member 15 and that the helical groove 15*b* is located to provide a communication between the upper and lower ends of support member 15 in the internal bore 14*a* of joint member 14. As shown by an imaginary line in FIG. 2, the joint member 14 of support shaft 10*b* is united with the lower end face of auger body 10*a* by friction welding. When the support shaft 10*b* is united with the auger body 10*a*, a portion 14*a* of joint member 14 in an extent shown by the imaginary line in FIG. 2 is eliminated as burrs during the process of friction welding.

Since the support shaft 10*b* of auger 10 is composed of the joint member 14 and the support member 15, the internal spline 14*b* of joint member 14 can be formed separately from the conical recess 15*a* of support member 15 without adapting a special machining process such as electric discharge machining. As a result, the machining time of the support shaft 10*b* can be shortened to decrease the manufacturing cost of the auger 10. As the joint member 14 is in the form of a cylindrical body, the engagement area of the joint member 14 with the auger body 10*a* can be decreased to reduce the portion 14*c* of joint member 14 eliminated during the process of friction welding. This is useful to reduce the material cost of the auger and to reduce the process time of friction welding.

In the support shaft 10*b* of auger 10, the joint member 14 is made of stainless steel, while the support member 15 is made of iron. As a result, the support member 15 can be machined in a simple manner to reduce the manufacturing cost of the shaft portion 10*b*. In the case that the support member 15 is made of a metallic material such as carbon steel smaller in coefficient of linear expansion than that of the joint member 14, the thermal stress caused by rise of temperature during the process of friction welding is decreased to decrease strain of the support shaft 10*b*. In the case that the support member 15 is made of a metallic material such as iron lower in specific heat or thermal conductivity than the joint member 14, the heating time during the process of friction welding can be shortened to reduce the process time of friction welding and to enhance the manufacturing efficiency of the auger 10.

It is also noted that the support member 15 is formed with the helical groove 15*b* extended from its lower end to its stepped portion to provide the communication between the upper and lower ends of support member 15 in the internal bore 14*a* of joint member 14. The helical groove 15*b* is useful to discharge the air under high pressure caused by the friction welding to the exterior from the interior of joint member 14 and to discharge therethrough a melted portion of the joint member 14 during the process of friction welding. This is effective to firmly weld the support shaft 10*b* to the auger body 10*a*.

Figure 5:
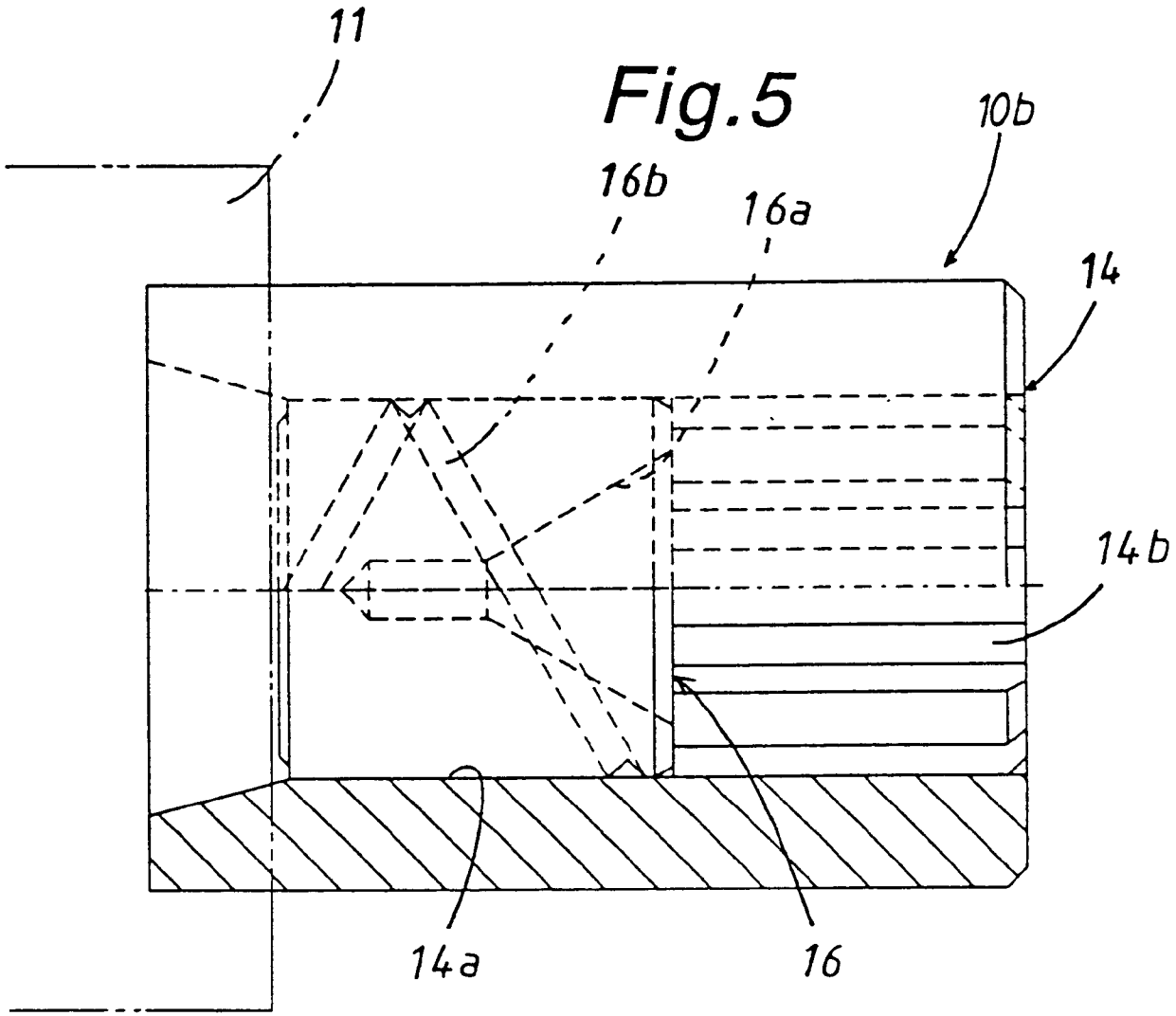
FIG. 5 is a partly sectional view of a modification of the support shaft.
Figure 6:
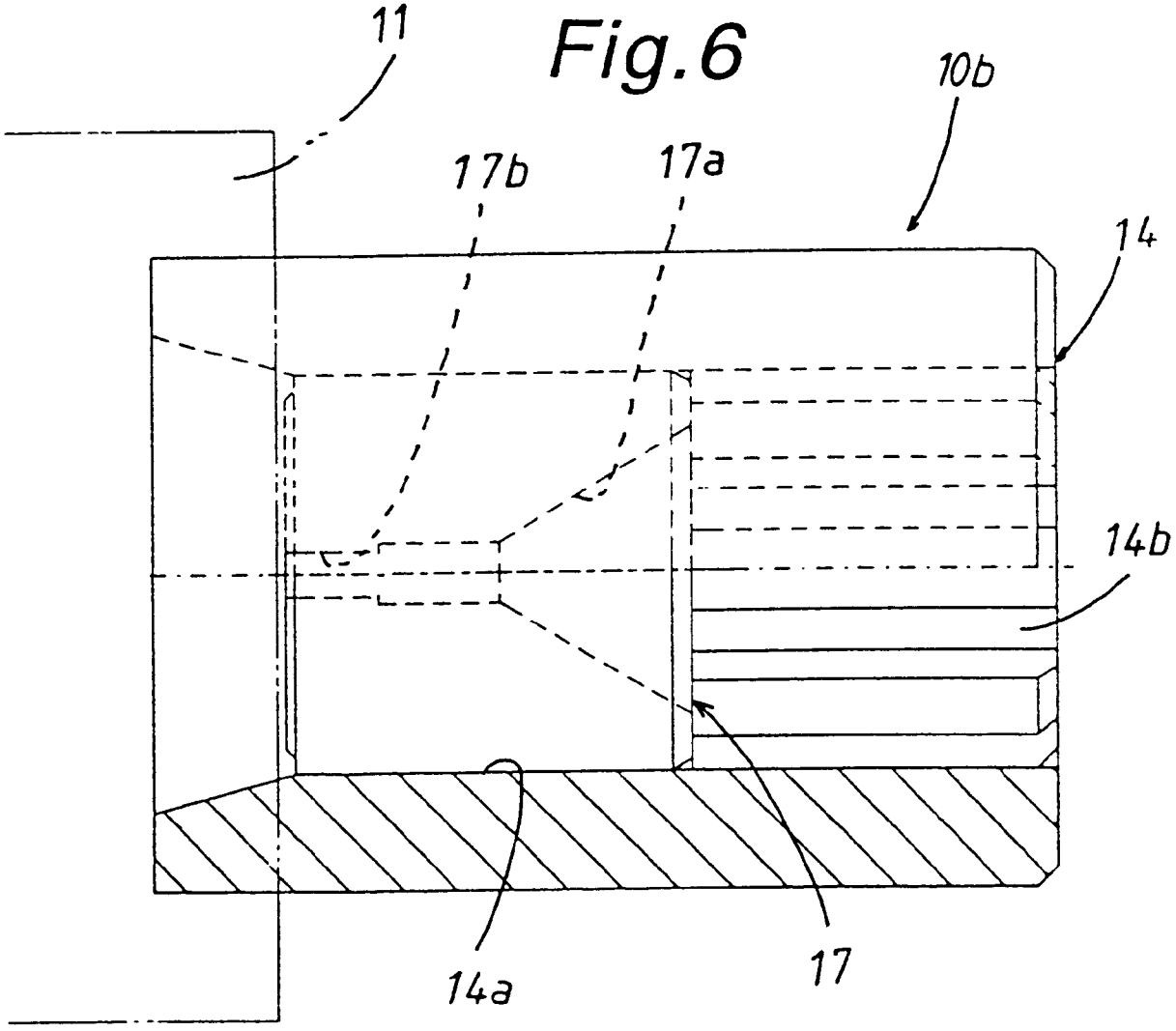
FIG. 6 is a partly sectional view of another modification of the support shaft.

In a practical embodiment, the groove 15 may be formed on the outer periphery of support member 15 in an appropriate shape or replaced with an axial hole formed in open communication with the conical recess 15*a* at the central portion of support member 15 to discharge the air under high pressure to the exterior. Illustrated in FIGS. 5 and 6 are modifications of the support member 15 in the support shaft 10*b* of auger 10. A support member 16 in the support shaft 10*b* shown in FIG. 5 is in the form of a columnar body formed at its outer periphery with a helical groove 16*b* extending from its lower end face to its upper end face and formed at its center with a conical recess 16*a*. A support member 17 in the support shaft 10*b* shown in FIG. 6 is in the form of a columnar body formed at its center with a conical recess 17*a* tapered upward and an axial hole 17*b* communicated with the upper end face of the columnar body.

What is claimed is:

1. An auger type ice making machine having an auger composed of an auger body integrally formed thereon with a helical blade and a support shaft united with a lower end of the auger body, the auger being mounted for rotary movement with an evaporator housing and connected at its support shaft to an output shaft of a drive mechanism for rotation therewith, wherein the support shaft of said auger is composed of a cylindrical joint member formed in a predetermined axial length and having a joint portion formed to be coupled with the output shaft for rotation therewith and a columnar support member coupled with art internal bore or the joint member, and wherein the columnar support member is formed with a conical recess tapered upward from its lower end and positioned concentrically with the internal bore of the joint member.

2. An auger type ice making machine as claimed in claim 1, wherein the joint portion of said joint member is formed with an internal spline.

3. An auger type ice making machine as claimed in claim 1, wherein the columnar support member is located at a position spaced in a predetermined distance lower than the upper end of the joint member when the support shaft of said auger is welded to the auger body.

4. An auger type ice making machine as claimed in claim 1, wherein the joint member and the columnar support member of said auger are made of different metallic materials.

5. An auger type ice making machine as claimed in claim 1, wherein the columnar support member is made of a metallic material smaller in coefficient of linear expansion or specific heat than that of the joint member or lower in thermal conductivity than that of the joint member.

6. An auger type ice making machine as claimed in claim 1, wherein the support shaft of said auger is provided with a communication groove for communicating an end face of the joint member engaged with the lower end face of said auger body to the exterior.

7. An auger type ice making machine as claimed in claim 6, wherein said communication groove is formed on an outer periphery of said columnar support member.

8. An auger type ice making machine as claimed in claim 6, wherein said communication groove is formed in a central portion of said columnar support member and communicated with the conical recess of said support member.

* * * * *